United States Patent [19]

Arnsteiner

[11] Patent Number: 4,635,954

[45] Date of Patent: Jan. 13, 1987

[54] SKI WITH IMPROVED RUNNING SURFACE

[75] Inventor: Anton Arnsteiner, Mittersill, Austria

[73] Assignee: Blizzard Gesellschaft m.b.H., Salzburg, Austria

[21] Appl. No.: 738,551

[22] Filed: May 28, 1985

[30] Foreign Application Priority Data

May 25, 1984 [AT] Austria ..... 1730/84
Apr. 30, 1985 [AT] Austria ..... 1293/85

[51] Int. Cl.[4] ..... A63C 5/00
[52] U.S. Cl. ..... 280/604; 280/610
[58] Field of Search ..... 280/601, 604, 608, 609, 280/610

[56] References Cited

U.S. PATENT DOCUMENTS

| | | | |
|---|---|---|---|
| 3,520,546 | 7/1970 | Joseph | 280/601 |
| 4,027,895 | 6/1977 | Sarsson | 280/604 |
| 4,272,577 | 6/1981 | Syng | 280/604 X |
| 4,595,215 | 6/1986 | Liitola | 280/604 |

FOREIGN PATENT DOCUMENTS

| | | | |
|---|---|---|---|
| 1120965 | 3/1982 | Canada | 280/610 |
| 0086939 | of 0000 | European Pat. Off. | 280/604 |
| 2248726 | 4/1973 | Fed. Rep. of Germany | 280/604 |
| 3003503 | 9/1980 | Fed. Rep. of Germany . | |
| 3113360 | 5/1982 | Fed. Rep. of Germany | 280/610 |
| 1595767 | 6/1970 | France | 280/610 |
| 0116372 | 9/1980 | Japan | 280/610 |
| 564953 | 8/1975 | Switzerland | 280/604 |

OTHER PUBLICATIONS

Skiing, Nov. 1985, p. 138.

*Primary Examiner*—Nancy A. Swisher
*Attorney, Agent, or Firm*—Karl F. Ross; Herbert Dubno

[57] ABSTRACT

A running surface coating for a ski, particularly for a cross country ski, comprising a running surface coating segment located in the middle region of the ski having a larger friction coefficient than the remaining running surface coating, this coating segment being formed from a coating mixture of a polyethylene and an elastomer. The coating mixture comprises a polyethylene, from 20 to 80 wt. %, preferably from 50 to 75 wt. %, and an elastomer, accordingly, from 80 to 20 wt. %, preferably from 50 to 25 wt. %. The coating segment may be enlarged to include the entire running surface coating.

16 Claims, 6 Drawing Figures

SKI WITH IMPROVED RUNNING SURFACE

FIELD OF THE INVENTION

My present invention relates to a running surface coating for skis, particularly cross-country skis, wherein at least a middle region along the length of the ski has an increased friction coefficient in contrast to the remaining running surface coating or surfaces. The invention also relates to an improved ski utilizing such a running surface coating.

BACKGROUND OF THE INVENTION

Known skis of the prior art generally comprise a narrow strip of wood, metal or the like having a tapered, front ski tip and a usually blunt rear end. They have a bottom or running surface which can be coated with a polymeric substance such as polyethylene and/or a wax to improve the sliding and other properties of the skis.

Bindings for holding or mounting the foot or footwear such as a boot are provided on the upper surface of a ski in the middle region of the length of the ski.

A variety of techniques have been used to improve the sliding, pushing and climbing properties of the running surface of skis.

Good sliding properties as well as the ability to climb and push are required particularly of a cross country ski. These properties can be attained by waxing the middle of the running surface of the ski by hard wax and/or other dabbing waxes e.g. klister wax.

It is also known to form a climbing aid by providing contours in the running surface which grip the snow track unidirectionally. This climbing aid may be located in the ski's center region and the formation can have a scale-like shape, a prong-like shape, or a step-like form.

These shapes are impressed or embossed in the polyethylene coating on the running surface.

The disadvantage of waxed skis where the wax forms the climbing aid, is that either the sliding properties of an optimally waxed cross country ski or the climbing properties of an optimally waxed ski can be optimized but not both. The climbing and sliding properties of the cross country ski with this climbing aid are always inferior to the optimum possible therefore, since there is always a trade-off between these two properties.

A disadvantage of mechanical (contoured) climbing aids is that mere surface abrasion is enough to reduce or eliminate the effectiveness of the contours and frequently use of skis with such contours generates a considerable amount of noise.

A coating for the running surface of a ski comprising a mixture of an elastomer and hard fiber component is also known as a climbing aid. The fibers are designed to project partially from the elastomer matrix and engage or grip the snow. The disadvantage of this climbing aid is that the fiber components are tend to ice up under various snow and temperature conditions.

German Patent document DE-OS Pat. No. 30 03 503 proposes the flame treatment with a gas flame of the plastic material on the ski bottom or running surface in the middle region of the ski to increase the adhesion between the snow and the ski in this region.

The flame treatment of the plastic material is, however, problematical particularly because of nonreproducibility and the unpredictability of the result.

The result depends on the duration and intensity of the flaming, so that variations in quality can scarcely be avoided. The heating or flaming may affect only a very thin layer of the polyethylene upper surface, so that by natural abrasion, the polyethylene upper surface after long use is worn off or fouled up and the layer then no longer will have an increased friction coefficient.

OBJECT OF THE INVENTION

It is an object of my invention to provide an improved running surface coating for a ski, particularly a cross country ski, whereby the disadvantages outlined above are avoided and, of course, to provide a ski with the improved surface.

It is another object of my invention to provide an improved running surface coating for a ski which provides a running surface having optimal climbing and sliding properties, but which retains these properties longer than a waxed ski and which does not ice-up as readily due to weather or trail conditions.

It is a further object of my invention to provide an improved running surface coating for a ski, which is long lasting in comparison to a wax coating, but does not generate noise as do mechanical contours or formations on the running surface of the ski.

It is yet another object of my invention to provide an improved running surface coating for a ski which retains desirable sliding and climbing properties longer than either a wax coating or special contours on the running surface of the ski.

It is a further object of my invention to provide a ski having improved climbing, sliding and pushing properties in comparison to those of the prior art, wherein this improved ski is of a more uniform quality and retains its improved properties longer than the skis of the prior art described.

SUMMARY OF THE INVENTION

These objects and others which will become more apparent are attained in accordance with my invention in a running surface coating for a ski, particularly for a cross country ski (and with a ski provided with such coating), wherein the running surface coating has a coating segment of increased friction coefficient preferably located at least in the middle region of the length of the ski.

According to my invention this coating segment of increased friction coefficient is formed from a coating mixture comprising a polyethylene and an elastomer. This coating mixture comprises 20–80 wt.% polyethylene and 80–20 wt.% elastomer.

In a running surface coating so formed the frictional coefficient thereof with respect to the snow or the trail depends on a partial penetration of the snow particles into this climbing and pushing aid, when the ski is pressed against the snow or trail with force during the pushing process with slight load, as in the sliding process, the snow particles cannot penetrate materially into the climbing aid, whereby the ski can easily slide over the trail or snow surface.

The running surface coating structure of this invention has the advantage that by preselection of the coating mixture proportions it is possible to adjust the hardness of the elastomer-polyethylene mixture so as to improve the sliding and climbing properties of the ski to the desired degree. Mixtures with greater elastomer proportions are particularly suitable for dry snow conditions, providing good climbing properties without impairing sliding properties, while mixtures with greater polyethylene proportions are particularly suitable for wet snow conditions, providing good sliding properties without impairing or negatively influencing climbing properties.

Consequently, as with waxed running surfaces in which there is a waxed ski for old granular snow and a special ski for pulverized crystaline snow conditions, I can provide with the described climbing aid of our invention a special ski for wet snow conditions and a special ski for dry snow conditions. Both of these special skis use mixture proportions for the coating segment according to the type of surface and conditions to the encountered.

A further advantage of this climbing aid of the invention is that it is not inclined to icing with trail track conditions near the freezing point. The running surface coating of our invention is distinguished by a long effective life, since not only the upper surface, but also the entire layer thickness has the required sliding and climbing properties. That means that during naturally occuring wear or abrasion in ski runs, particularly in cross country runs, no reduction of climbing and other desirable properties occurs, since any of the upper surface of the running surface coating removed by abrasion is replaced by an equally operating lower layer of the same material.

Preferably the coating segment of increased friction coefficient comprises from 50 to 75 wt.% polyethylene and accordingly 50 to 25 wt.% elastomer.

A preferred embodiment of the invention provides that the running surface between the ski tip and the aforementioned middle region and the running surface between the middle region and the rear end of the ski each comprises polyethylene. That is, the regions coated with polyethylene are those which do not encompass the coating segment of increased friction coefficient formed from the polyethylene-elastomer mixture.

The coating segment of increased friction coefficient found in the middle region of the ski extends either over the entire ski width or only over a portion of the ski width, advantageously from 95–60% of the ski width.

In the case where the foregoing coating segment of increased friction coefficient covers only a part of the ski width, the residual portion of the ski width, advantageously 5 to 40%, and of course near or adjacent the inner edge of the ski, may comprise either a polyethylene strip having the same density and molecular weight as the coating portion in front and to the rear of it or a polyethylene strip of a higher density and molecular weight.

This polyethylene strip adjacent the coating segment of increased friction coefficient may extend over the entire length of the ski and is therefore limited in its extent only by the length of the ski. Particularly when the aforementioned residual portion of polyethylene has a higher density than the adjacent polyethylene coatings, it is appropriate that this strip be extended over the entire length of the ski.

Particularly when the coating segment in the middle region of increased friction coefficient does not extend over the entire ski width and a polyethylene strip is positioned adjacent the inner edge of the ski in the middle region adjacent the coating segment, with the cross country ski so formed the new technique in cross country skiing (pushing off by a single or double herringbone or skating step—"siitonen" step) can be practiced. Sliding on the inner side of the ski is improved by such a polyethylene coating; the sliding on the running surface inner side compared with that of the polyethylene/elastomer mixture is improved.

Furthermore by increasing the molecular weight and thickness of the polyethylene strip an increased abrasion resistance is additionally obtained on the inner side of the ski running surface.

It is understood that one can employ the running surface coating of my invention is some alpine skis. Employment in alpine touring skis and in cross country skis for travel over land without a prepared trail is also conceivable. In this case we provide the entire running surface of the ski with a coating formed from the coating mixture of polyethylene and elastomer according to the invention.

The entire running surface may in other cases be coated with the running surface coating of the invention formed from the coating mixture comprising a polyethylene and an elastomer.

Any of the following substances can be used as the elastomer:

polychloroprene
vulcanized rubber
nitrile rubber
polyisobutylene
polybutadiene
styrene-butadiene copolymer
silicone rubber Mixtures of any two or more of these elastomers can also be used as the elastomer of the running surface coating.

The following proportions of polyethylene and elastomer in the coating mixture are used in preferred embodiments:

50 wt.% polyethylene and 50 wt.% polyisobutylene
25 wt.% polybutadiene and 75 wt.% polyethylene
75 wt.% polyethylene and 25 wt.% styrenebutadiene copolymer
50 wt.% polyethylene and 50 wt.% silicone rubber.

BRIEF DESCRIPTION OF THE DRAWING

The above and other objects, features and advantages of this invention will become more readily apparent from the following description, reference being made to the accompanying highly diagrammatic drawing in which.

SPECIFIC DESCRIPTION

Figure 3A:
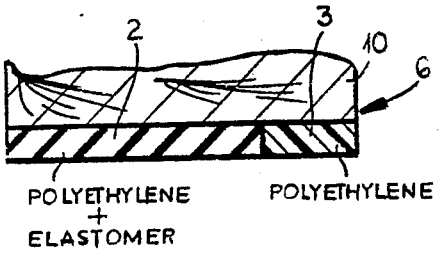
FIG. 3A is a section along line IIIA—IIIA of FIG. 3.
Figure 3B:
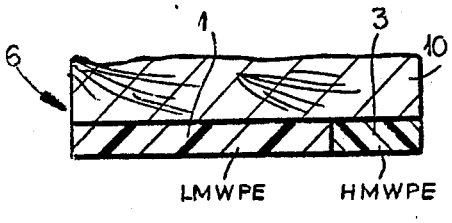
FIG. 3B is a section along line IIIB—IIIB of FIG. 3.
Figure 1:
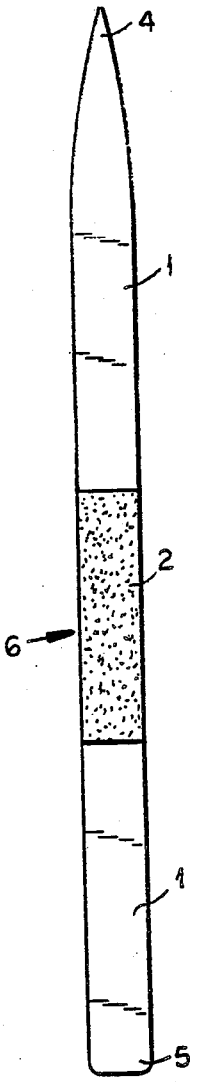
FIG. 1 is a top plan view of a first embodiment of a ski provided with the running surface coating of the invention.

In the drawing the running surface coating segment 2 in contrast to the remaining running surface has an increased friction coefficient (as an aid to climbing). The running surface coating segment 2 is found on the middle region of the ski. This middle region in a ski of a 2.100 mm length measures from the mounting point 6 of the bindings, 300–400 mm in the direction of the ski tip 4 and 300–400 mm in the direction of the ski rear end 5 (a total length of between 600 and 800 mm). With a ski length of 2.050 mm this middle region measures from the mounting point 6 of the bindings, 200–250 mm in the direction of the ski tip 4 and 300–400 mm in the direction of the ski rear end 5.

Figure 2:
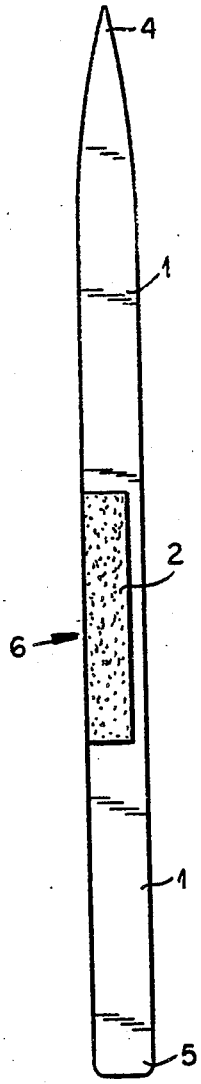
FIG. 2 is a similar top plan view of a second embodiment of a ski provided with the running surface coating of this invention.
Figure 3:
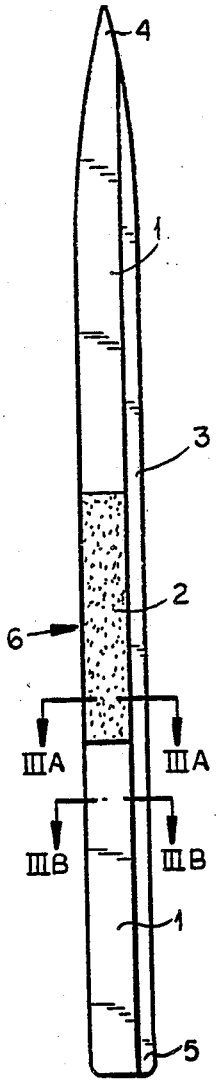
FIG. 3 is a top plan view of a third embodiment of a ski provided with the running surface coating of the invention.

The running surface coating segment 2 can comprise a mixture of rubber and polyethylene. In front of and to the rear of the coating segment 2 one finds a coated portion 1 comprising a polyethylene coating. In the embodiments of FIGS. 2 and 3 the coating segment 2 of increased friction coefficient does not extend over the entire width of the ski. The residual width of the ski is occupied by a polyethylene strip 3.

In the embodiment shown in FIG. 3 the polyethylene strip 3 extends over the entire length of the ski and has a higher density (for example, 0.97 g/cm$^3$) than the coated portion 1 in front of and behind the coated portion 2 (coated portion 1 has a density of 0.94 g/cm$^3$).

Figure 4:
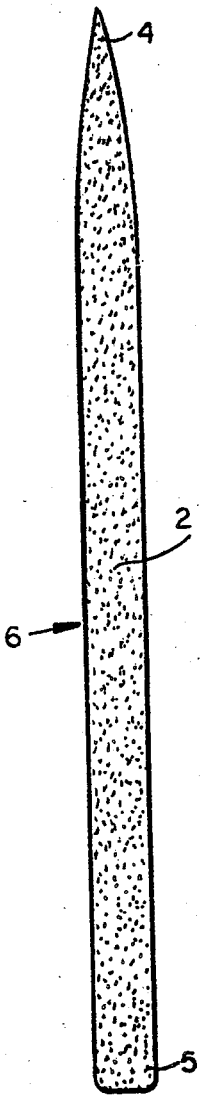
FIG. 4 is a top plan view of a fourth embodiment of a ski provided with the running surface coating of the invention.

In the embodiment shown in FIG. 4 the running surface coating segment 2 extends over the entire length of the ski.

The coating segment 2 in the drawing has been stippled to distinguish it from the remainder of the ski whose body is seen at 10.

EXAMPLE 1

In a cross country ski of a 2.100 m length the running surface coating segment 2 of increased friction coefficient extends about 300 to 400 mm in the direction of the ski tip 4 and about 300–400 mm in the direction of the ski rear end 5 from the mounting point 6 of the bindings and comprises a mixture of polyethylene and elastomer extending over the entire ski width. The proportions of the mixture applied in this region are 20 wt.% parts polyethylene to 80 wt.% parts elastomer. In front of and to the rear of the running surface coating segment 2 of increased friction coefficient the ski is coated with polyethylene.

The elastomers in the specific cases are:

polychloroprene;
vulcanized rubber;
nitrile rubber;
polyisobutylene;
polybutadiene;
styrene-butadiene copolymer; and
silicone rubber The skis, which are provided with these running surface coating, have optimal sliding and climbing properties in dry snow conditions.

EXAMPLE 2

The running surface coating segment 2 of increased friction coefficient is dimensioned and positioned as in the first example. The mixture proportions of polyethylene to elastomer is 80 wt.% polyethylene to 20 wt.% elastomer. The elastomer portion in the mixture corresponds to each of the elastomers described in Example 1. These skis have optimum climbing and sliding properties in wet snow conditions.

EXAMPLE 3

In a cross country ski of length 2.050 mm the running surface coating segment 2 in the middle region of the ski extends 200–250 mm in the direction of the ski tip 4 and about 200–250 mm in the direction of the ski rear end 5 from the mounting point 6 of the ski bindings and comprises a mixture of polyethylene and elastomer as described in Example 1 or 2, which extends across 90% of the ski width. The surface in front of and to the rear of the coating segment 2 of our invention is coated with polyethylene. The remaining running surface in the middle of the ski on the ski's inner side with respect to the wearer of the ski comprises a pure polyethylene strip 3, the thickness of this polyethylene strip being equal to that of the polyethylene coating to the front of and to the rear of the running surface coating segment 2 of the invention.

By application of a polyethylene strip to the remaining portion of the middle of the running surface of the ski uncoated by the coating segment 2 of our invention the suitability of the ski with running surface coating positioned as described in Example 1 and 2 for unilateral or bilateral herringbone steps (SIITONEN steps) used in present day cross country skiing is still further improved.

EXAMPLE 4

The ski and composition of the mixture are here the same as in Example 3. The polyethylene strip on the inner side of the ski is however of a higher molecular weight and greater density than the coating to the front and rear of the coating segment 2 of the invention, that is 0.94 g/cm$^3$ on the front and rear portions of the running surface coating as opposed to 0.97 g/cm$^3$ on the inner side of the ski, whereby the coating on the inner side of the ski has an increased wear resistance.

EXAMPLE 5

In a ski with a coating segment 2 having an increased friction coefficient (as a climbing aid) positioned on the middle region of the ski running surface extending over the entire width of the ski, the coating segment 2 comprises 75 wt.% polyethylene and 25 wt.% rubber.

EXAMPLE 6

In a ski with a coating segment 2 having an increased friction coefficient (as a climbing aid) positioned on the middle region of the ski running surface extending over the entire width of the ski, the coating segment 2 comprises 50 wt.% polyethylene and 50 wt.% polyisobutylene.

EXAMPLE 7

In a ski with a coating segment 2 having an increased friction coefficient (as a climbing aid) positioned on the middle region of the ski running surface extending over the entire width of the ski, the coating segment 2 comprises 75 wt.% polyethylene and 25 wt.% polybutadiene.

EXAMPLE 8

In a ski with a coating segment 2 having an increased friction coefficient (as a climbing aid) positioned on the middle region of the ski running surface extending over the entire width of the ski, the coating segment 2 comprises 75 wt.% polyethylene and 25 wt% styrene-butadiene copolymer.

EXAMPLE 9

In a ski with a coating segment 2 having an increased friction coefficient (as a climbing aid) positioned on the middle region of the ski running surface extending over the entire width of the ski, the coating segment 2 comprises 50 wt.% polyethylene and 50 wt.% silicone rubber.

We claim:

1. A ski comprising front tip and rear end members defining a ski length, said ski including a top surface and a bottom running surface along said ski length, said running surface having a coating which covers a portion of the middle region defined by the length of said ski, and extending substantially across the width thereof said coating consisting essentially of 20 to 80 wt. % of a polyethylene, and from 80 to 20 wt.% of an elastomer, said coating being free of particles and fibers.

2. The ski according to claim 1, comprising from 50 to 75 wt.%, of polyethylene and from 50 to 25 wt. % of said elastomer.

3. The ski defined in claim 1 wherein said coating mixture forms a coating segment located only in the middle region of said ski, said coating segment having an increased friction coefficient in comparison to the remainder of said running surface.

4. The ski according to claim 3 wherein said remainder of said running surface comprises a polyethylene.

5. The ski according to claim 4 wherein said coating segment in the middle region of said ski extends only partially across the width of said ski from the outer edge of said ski, and the residual portion of said running surface coating in said middle region of said ski comprises a polyethylene strip having a friction coefficient larger than that of the polyethylene portion of said running surface coating outside of said middle region of said ski.

6. The ski according to claim 5, wherein said coating segment extends across from 95 to 60% of said width of said ski.

7. The ski according to claim 5 wherein said strip comprises a polyethylene of a higher molecular weight and density than the remainder of said polyethylene between said coating segment and the tip of said ski and between said coating segment and the rear end of said ski.

8. The ski according to claim 7 wherein said strip adjacent said inner edge of said ski extends the entire length of said ski.

9. The ski according to claim 1 which extends over the entire width of said ski.

10. The ski according to claim 1 wherein said mixture coats the entire area of said running surface of said ski.

11. The ski according to claim 1 wherein said elastomer contains at least one member selected from the group consisting of polychloroprene, vulcanized rubber, nitrile rubber, polyisobutylene, polybutadiene, styrene-butadiene copolymer, and silicone rubber.

12. The ski according to claim 1 wherein said coating mixture comprises 50 wt. % polyethylene and 50 wt. % polyisobutylene.

13. The ski according to claim 1 wherein said coating mixture comprises 25 wt. % polybutadiene and 75 wt. % polyethylene.

14. The ski according to claim 1 wherein said coating mixture comprises 25 wt. % styrene-butadiene copolymer and 75 wt. % polyethylene.

15. The ski according to claim 1 wherein said coating mixture comprises 50 wt. % silicone rubber and 50 wt. % polyethylene.

16. The ski defined in claim 1 which is a cross country ski.

* * * * *